US010994431B2

(12) United States Patent
Robertson

(10) Patent No.: US 10,994,431 B2
(45) Date of Patent: May 4, 2021

(54) AMBULATORY CUTTING DEVICE

(71) Applicant: Roger Craig Robertson, Rockford, IL (US)

(72) Inventor: Roger Craig Robertson, Rockford, IL (US)

( * ) Notice: Subject to any disclaimer, the term of this patent is extended or adjusted under 35 U.S.C. 154(b) by 0 days.

(21) Appl. No.: 16/696,736

(22) Filed: Nov. 26, 2019

(65) Prior Publication Data

US 2020/0171682 A1 Jun. 4, 2020

Related U.S. Application Data

(60) Provisional application No. 62/775,026, filed on Dec. 4, 2018.

(51) Int. Cl.
*B26B 5/00* (2006.01)
*E04D 15/06* (2006.01)

(52) U.S. Cl.
CPC ..... *B26B 5/005* (2013.01); *E04D 15/06* (2013.01)

(58) Field of Classification Search
CPC ..... B26B 5/005; B26B 25/00; B26B 3/08; E04D 15/06; E04D 15/00; E04D 15/03
USPC ... 30/273, 272.1, 275, 275.4, 280, 282, 283, 30/284, 289, 290, 293, 294, 296.1
See application file for complete search history.

(56) References Cited

U.S. PATENT DOCUMENTS 755,803 A 3/1904 Smith
903,868 A 11/1908 Kepplinger
2,684,533 A 7/1954 Kern
2,806,283 A 9/1957 Brennan
2,920,388 A 1/1960 Herndon, Jr.
3,695,713 A 10/1972 Rothi et al.
3,859,725 A 1/1975 Anderson et al.
4,162,809 A 7/1979 Anderson et al.
4,330,938 A 5/1982 Martin
4,549,350 A 10/1985 Patillo
4,620,368 A 11/1986 Bowman
4,683,657 A 8/1987 Anderson et al.
4,948,451 A 8/1990 Foltz
5,347,719 A 9/1994 Scharf
5,387,308 A 2/1995 Heavrin
6,135,566 A 10/2000 Anderson
6,629,370 B1 * 10/2003 Sposato ..... B26B 29/06 30/29
8,978,256 B1 3/2015 Loyer
2010/0007117 A1 * 1/2010 Morris ..... B60D 1/143 280/515
2015/0306779 A1 * 10/2015 Napolitano ..... B26D 5/10 83/880

* cited by examiner

*Primary Examiner* — Phong H Nguyen
(74) *Attorney, Agent, or Firm* — Dunlap Bennett & Ludwig, PLLC

(57) ABSTRACT

An ambulatory cutting device is provided. The ambulatory cutting device provides a blade mounted, by way of a blade holding assembly, to a wheeled frame. The wheeled frame has handles for a user to push the wheeled frame along a surface supporting a roofing membrane or other cuttable membrane, wherein the blade holding assembly maintains the mounted blade at an elevation just below the supporting surface so that the membrane is cut as a user pushes the wheeled frame.

6 Claims, 4 Drawing Sheets

AMBULATORY CUTTING DEVICE

CROSS-REFERENCE TO RELATED APPLICATION

This application claims the benefit of priority of U.S. provisional application No. 62/775,026, filed 4 Dec. 2018, the contents of which are herein incorporated by reference.

BACKGROUND OF THE INVENTION

The present invention relates to roofing membrane and carpeting cutting devices and, more particularly, an ambulatory cutting device embodying a blade mounted to a wheeled frame, the wheeled frame adapted to be pushed forward by a user walking along a surface supporting the roofing membrane and/or carpeting that the device cuts.

Cutting carpets and roofing membranes typically requires the user of the cutting device to kneel or bend over during use, while moving backwards, making the task at hand uncomfortable, painful, and time consuming; not to mention that blindly moving backwards can be extremely dangerous on an elevated roof.

As can be seen, there is a need for a device for cutting roofing membrane and carpeting, wherein the cutting edge is operable by a user walking forward along the supporting surface. The present invention embodies a cutting edge mounted on a wheeled frame for effortlessly and ergonomically doing the cutting while walking upright behind and pushing the wheeled frame as the user goes.

SUMMARY OF THE INVENTION

In one aspect of the present invention, an ambulatory cutting device includes the following: a wheeled frame interconnecting one or more handles and one or more wheels; the wheeled frame includes a plurality of spaced apart frame attachment points; a blade holding assembly having a proximal end and a distal end; the proximal end includes an assembly attachment point for selectively engaging one of the plurality of spaced apart frame attachment points; the proximal end pivotably connected to the wheeled frame so that the blade holding assembly is movable between a plurality of operable positions and a storage position, wherein each of the plurality of operable positions has an associated angle of incident between the blade holding assembly and the wheeled frame; and the distal end providing a distal attachment point for removably attaching a blade for cuttingly engaging a supporting surface for the one or more wheels, wherein a midpoint of said blade is maintained by the blade holding assembly at an elevation level with a lowest point of the one or more wheels, wherein the distal attachment point includes a cavity for slidably receiving a blade handle of the blade.

In another aspect of the present invention, the ambulatory cutting device includes the following: a cotter pin hole in the distal end that communicates with the cavity; a handle hole in the blade handle; and a cotter pin dimensioned to operatively engage both the cotter pin hole and the handle hole when the blade handle is in the cavity, wherein the plurality of spaced apart frame attachment points through a plurality of spaced apart hitch pin holes; the assembly attachment point being an attachment hole in said proximal end; and a hitch pin dimensioned to selectively engage both said attachment hole and one of the plurality of spaced apart hitch pin holes in a locked engagement; and further including: one or more mounting plates attached to the wheeled frame, wherein the one or more mounting plates provide the plurality of spaced apart hitch pin holes.

These and other features, aspects and advantages of the present invention will become better understood with reference to the following drawings, description and claims.

DETAILED DESCRIPTION OF THE INVENTION

Figure 1:
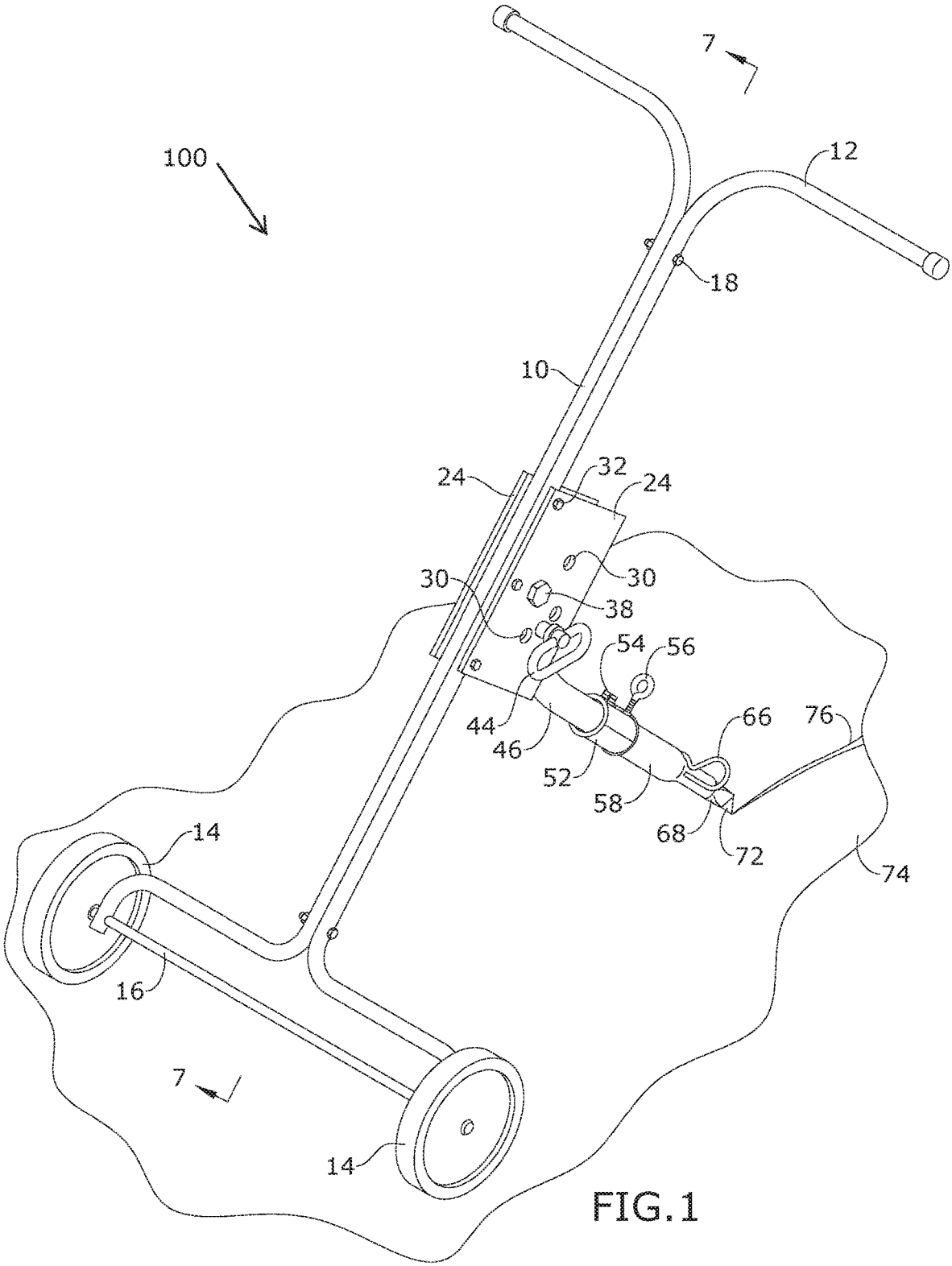
FIG. 1 is a perspective view of an exemplary embodiment of the present invention, shown in use.
Figure 2:
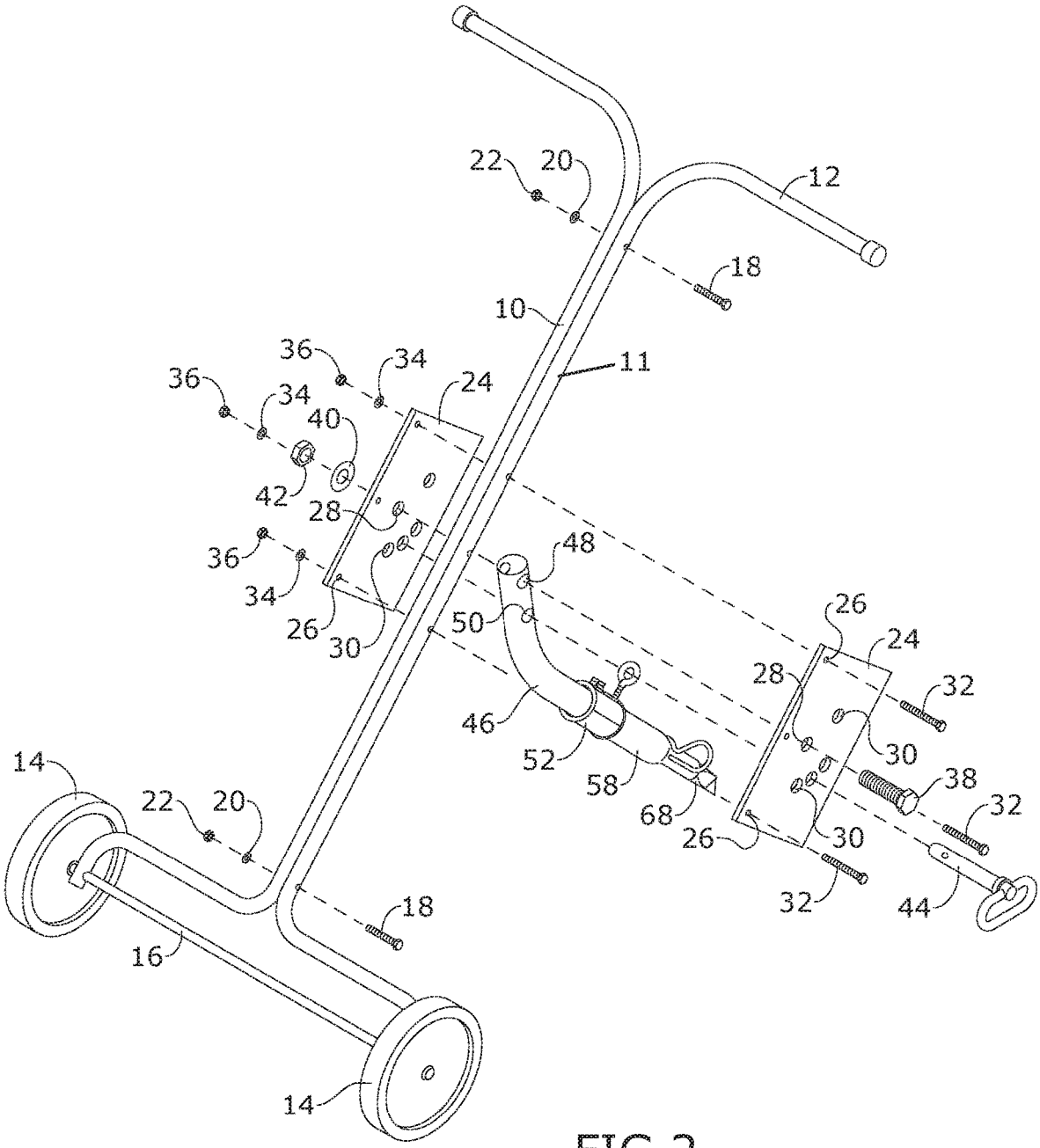
FIG. 2 is an exploded perspective view of an exemplary embodiment of the present invention.
Figure 3:
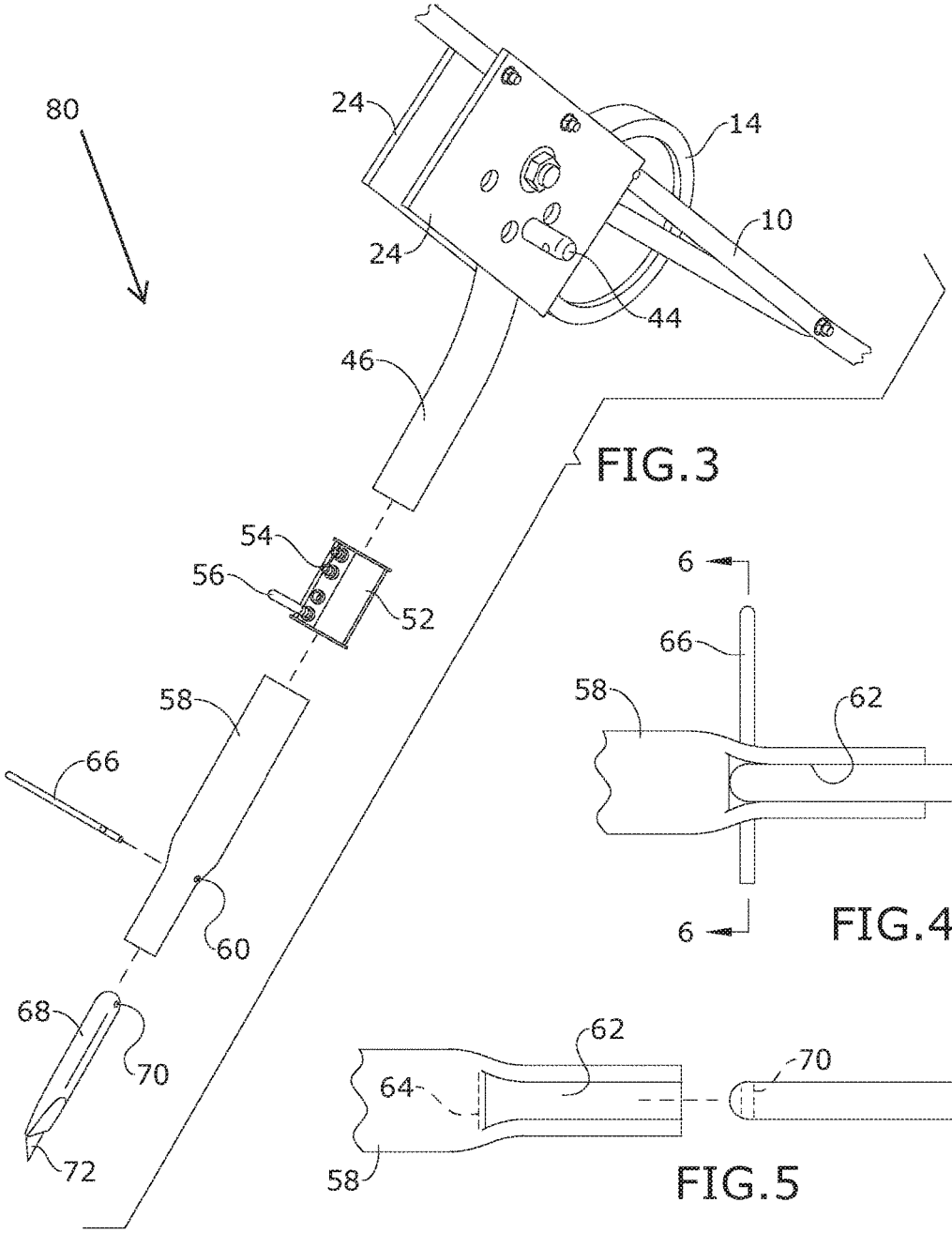
FIG. 3 is an exploded perspective view of an exemplary embodiment of a blade holding assembly 80 of the present invention.
Figure 4:
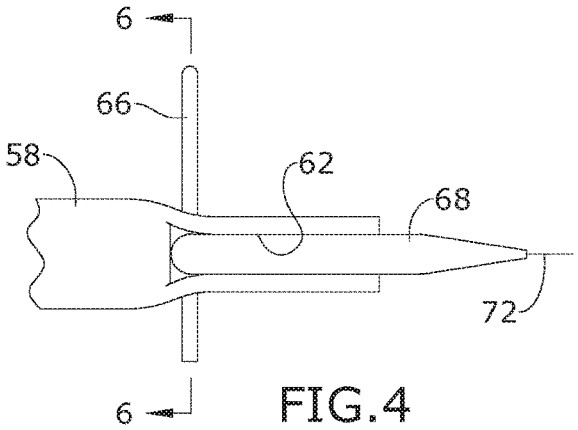
FIG. 4 is a detailed bottom view of an exemplary embodiment of a blade holder 58 of the present invention.
Figure 5:
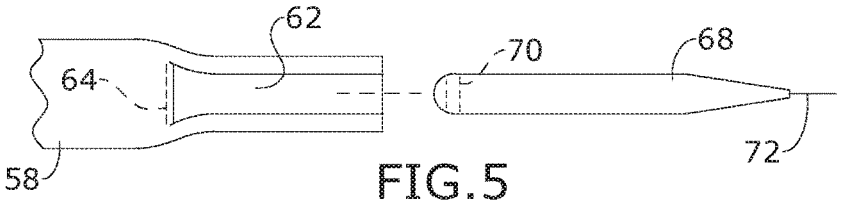
FIG. 5 is a detailed exploded bottom view of an exemplary embodiment of the blade holder 58 of the present invention, illustrating removal of a blade handle 68 from the blade holder 58.
Figure 6:
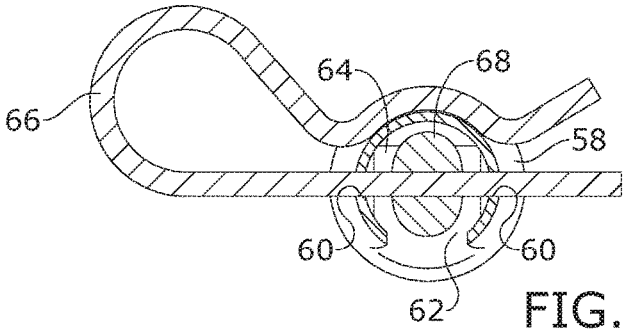
FIG. 6 is a section view of an exemplary embodiment of the present invention, taken along line 6-6 of FIG. 4.
Figure 7:
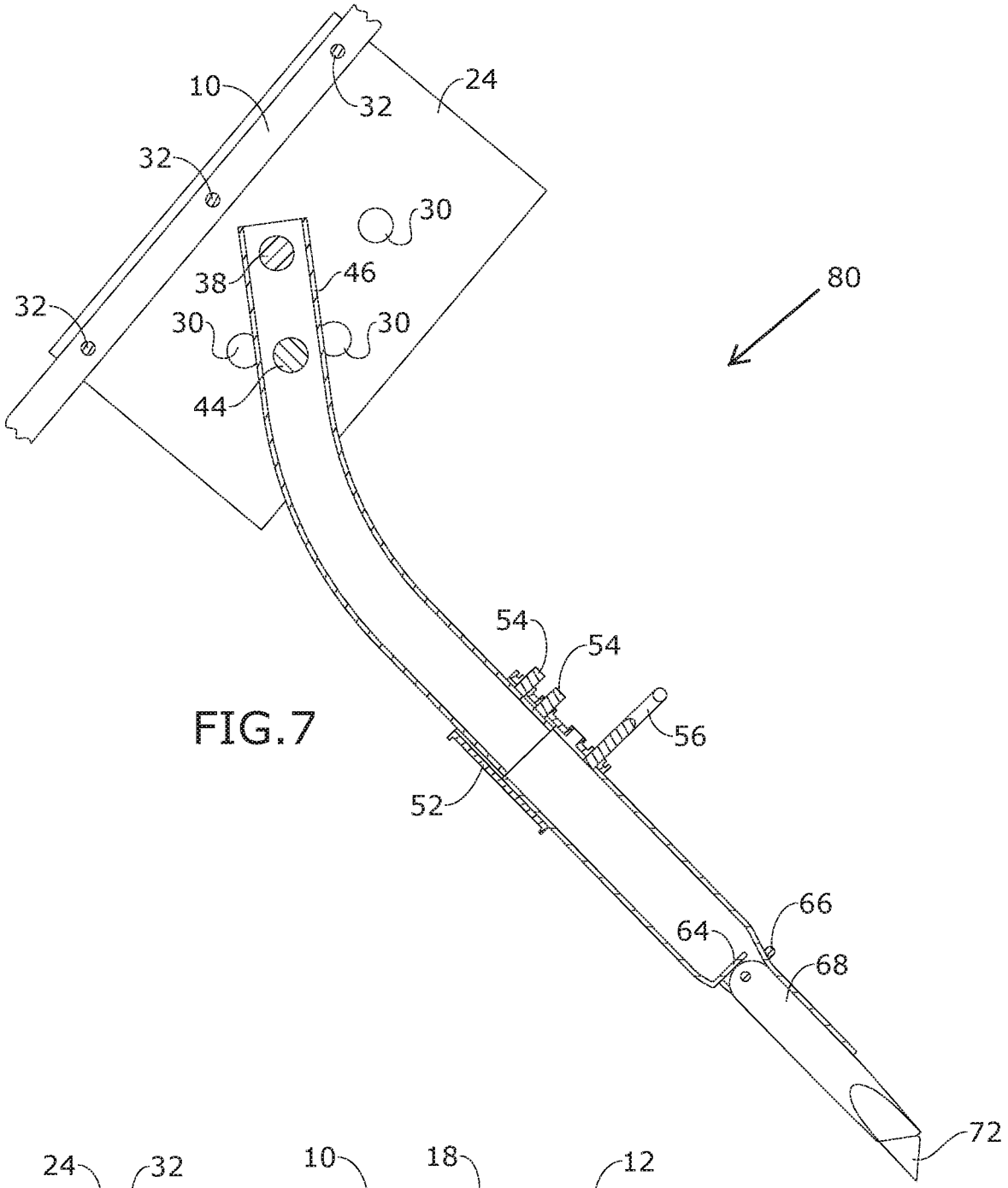
FIG. 7 is a section view of an exemplary embodiment of the blade holding assembly 80 of the present invention, taken along line 7-7 of FIG. 1.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides an ambulatory cutting device having a blade mounted, by way of a blade holding assembly, to a wheeled frame. The wheeled frame has handles for a user to push the wheeled frame along a surface supporting a roofing membrane or other cuttable membrane, wherein the blade holding assembly maintains the mounted blade at an elevation just below the supporting surface so that the membrane is cut as a user pushes the wheeled frame.

It should be understood by those skilled in the art that the use of directional terms such as upper, lower, upward, downwardly, top, left, right and the like are used in relation to the illustrative embodiments as they are depicted in the figures, the upward direction (or upper) being toward the top of the corresponding figures, downward direction being toward the bottom of the corresponding figures.

Referring to FIGS. 1 through 8, the present invention may include an ambulatory cutting device 100 for cutting roofing membrane 74, carpeting, or other membranes overlaying a walkable supporting surface. The ambulatory cutting device 100 embodies a cutting edge 72 mounted, by way of a blade holding assembly 80, to a wheeled frame 10 adapted to be pushed forward by an ambulatory user.

The wheeled frame 10 may include one or more frame members 11 extending between an upward handle 12 and wheels 14. The length of the frame members 11 can vary so long as the present invention works in accordance with the disclosure herein. In certain embodiments, the frame members 11 could be two ½ inch by 50-inch galvanized conduits, and in any event the frame members 11 would be joined with appropriate fasteners 18, 20, 22. The one or more frame members 11 may provide support for an axle 16 for the wheels 14 for rolling the ambulatory cutting device 100 along a surface supporting the roofing membrane 74 or carpeting to be cut.

Figure 8:
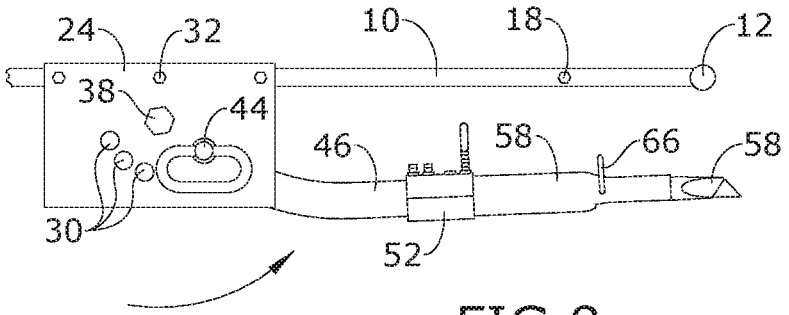
FIG. 8 is an elevation view of an exemplary embodiment of the blade holding assembly 80 of the present invention, shown in a stored position.

The blade holding assembly 80 may be removably mountable to the wheeled frame 10 by way of a hitch pin 44. The hitch pin 44 may be adapted to removably attach to mounting plates 24 providing a plurality of hitch pin holes 30, for selectively mounting the blade holding assembly 80 to different placements along the mounting plates 24, depending on which of the plurality of hitch pin holes 30 the user engages. Thereby, the blade holding assembly 80 may be moved between a plurality of operable positions and a storage position, as illustrated in FIG. 8.

The mounting plates 24 may be attached to the wheeled frame 10 by way of appropriate fastener holes 26 and 28 and fasteners 32, 34, 36, 38, 40, and 42. The orientation or angle of incident of the blade holding assembly 80 relative to the wheeled frame 10 is also adjustable based on rotating the blade holding assembly 80 about a pivot bolt 38 that engages an assembly pivot hole 48 in the latter and a plate pivot hole 28 in the former.

The blade holding assembly 80 may include an elbow 46 providing said assembly pivot hole 48 along a proximal end thereof. The elbow 46 may not have a curve to it, in certain embodiments. The proximal end may also include an elbow hitch pin hole 50 for effectuating the releasable connection of the blade holding assembly 80 to the wheeled frame 10. The opposing distal end of the elbow 46 may operatively associate with a proximal end of a blade holder 58 by way of a coupler 52 having an eye bolt 56 and set screws 54. In certain embodiments, the proximal end of the blade holder 58 and the distal end of the elbow 46 may be telescopically connected.

The blade holder 58 may be dimensioned and adapted to removably attach various blades 72; typically, these blades 72 are associated with a blade handle 68. The distal end of the blade holder 58 may provide an elongated cavity 62 for slidably receiving the blade handle 68, as well as a stop 64 in the cavity 62 for securing the blade handle 68 at a predetermined position. The interchangeable blades 72 may be a straight blade or a hook blade.

The proximal end of the blade holder 58 may include at least one cotter pin hole 60 that communicates with the elongated cavity 62. The blade handle 68 may provide a blade handle hole 70 that aligns with the cotter pin hole 60 when the blade handle 68 is disposed at least partly in the elongated cavity 62 so that a cotter pin 66 can releasably engage both the distal end of the blade holder 58 and the slidably received blade handle 68 for securing the blade 72 at a selective location relative to the distal end of the blade holder 58. If there are more than one cotter pin holes 60, there is selectivity during this attachment process.

A method of using the present invention may include the following. The ambulatory cutting device 100 disclosed above may be provided. A user would selectively engage the blade handle 68 and the distal end of the blade holder 58 by way of the cotter pin 66. The user may in alternatively or in addition selectively engage the blade holding assembly 80 to the mounting plates 24 by way of the hitch pin 44 and one of the plurality of hitch pin holes 30 for ergonomically customizing the present invention. For instance, so that when the user stood on a surface that supported the membrane to be cut 74 and the wheels 14, the handles 12 where in arm's reach while the blade 72 abuts the membrane to be cut 74. Then the user may step down on the blade holder 58 so that the blade 72 punctures the membrane to be cut 74, and then the user walks forward while pushing down on the handles 12, almost like you would push a lawn mower, forming a cut line 76 by way of the blade 72. The cut lines 76 allow the user dismantle the cut surface faster than other would happen without cut lines 76.

It should be understood, of course, that the foregoing relates to exemplary embodiments of the invention and that modifications may be made without departing from the spirit and scope of the invention as set forth in the following claims.

What is claimed is:

1. An ambulatory cutting device, comprising:

a wheeled frame having one or more frame members extending between one or more handles and one or more wheels;

at least one mounting plate connected to the one or more frame members;

the at least one mounting plate includes a plurality of spaced apart frame attachment points;

a blade holding assembly having a proximal end and a distal end;

the proximal end includes an assembly attachment point for selectively engaging one of the plurality of spaced apart frame attachment points;

the proximal end pivotably connected to the at least one mounting plate so that the blade holding assembly is movable between a plurality of operable positions and a storage position, wherein each of the plurality of operable positions has an associated angle of incident between the blade holding assembly and the one or more frame members; and the distal end providing a distal attachment point for removably attaching a blade for cuttingly engaging a supporting surface for the one or more at least one wheeled, whereby the blade is disposed between the one or more wheels and the one or more handles in both the plurality of operable positions and the storage position.

2. The ambulatory cutting device of claim 1, wherein the at least one mounting plate comprises two spaced apart mounting plates.

3. The ambulatory cutting device of claim 1, wherein the distal attachment point includes a cavity for slidably receiving a blade handle of the blade.

4. The ambulatory cutting device of claim 3, further comprising:

a cotter pin hole in the distal end that communicates with the cavity;

a handle hole in the blade handle; and a cotter pin dimensioned to operatively engage both the cotter pin hole and the handle hole when the blade handle is in the cavity.

5. The ambulatory cutting device of claim 3, further comprising a hitch pin dimensioned to selectively engage both said assembly attachment point and one of the plurality of spaced apart frame attachment points in a locked engagement.

6. The ambulatory cutting device of claim 5, wherein the the plurality of spaced apart frame attachment points comprises three or more operable holes and one storage hole, wherein each operable hole associated with one of the plurality of operable positions.

* * * * *